US005992194A

United States Patent [19]

Baukholt et al.

[11] Patent Number: 5,992,194

[45] Date of Patent: Nov. 30, 1999

[54] DEVICE FOR UNLOCKING DOORS

[75] Inventors: Theo Baukholt, Kriftel; Klaus-Peter Rathmann, Frankfurt; Jens Lübben, Rastede, all of Germany

[73] Assignee: VDO Adolf Schindling AG, Frandfurt, Germany

[21] Appl. No.: 08/744,205

[22] Filed: Nov. 5, 1996

[30] Foreign Application Priority Data

Dec. 20, 1995 [DE] Germany ..... 195 47 727

[51] Int. Cl.[6] ..... E05B 47/00

[52] U.S. Cl. ..... 70/279; 70/264; 292/201

[58] Field of Search ..... 70/275, 279, 277, 70/264; 292/144, 201, 216, 336.3, DIG. 23

[56] References Cited

U.S. PATENT DOCUMENTS

| | | | |
|---|---|---|---|
| 4,979,384 | 12/1990 | Malesko et al. | 70/279 X |
| 5,180,198 | 1/1993 | Nakamura et al. | 70/264 X |
| 5,409,273 | 4/1995 | Claar et al. | 292/201 |
| 5,537,848 | 7/1996 | Grzanka et al. | 70/279 |
| 5,564,761 | 10/1996 | Mizuki et al. | 292/201 |
| 5,603,537 | 2/1997 | Amano et al. | 70/264 X |
| 5,639,130 | 6/1997 | Rogers, Jr. et al. | 292/201 X |
| 5,656,899 | 8/1997 | Kuroda | 292/201 X |
| 5,676,003 | 10/1997 | Ursel et al. | 292/201 X |

FOREIGN PATENT DOCUMENTS

| | | | |
|---|---|---|---|
| 0 589 158 A1 | 3/1994 | European Pat. Off. . | |
| 3732138 | 4/1988 | Germany | 70/279 |

*Primary Examiner*—Suzanne Dino Barrett
*Attorney, Agent, or Firm*—Martin A. Farber

[57] ABSTRACT

A lock including a device for unlocking the door of a motor vehicle in case of a malfunction of the lock, as in the event of an accident of the motor vehicle, to open the lock or allow the lock to be reliably opened manually. The unlocking is triggered by a setting device which can be operated during a malfunction independently of a supply of electric current for unlocking the door. Also included in the lock is a rotary latch for engaging a closure wedge upon a locking of the door, and a pawl which holds the latch in a locked position during normal locking of the door, but releasing the latch upon operation of the setting device in the event of a sensed malfunction.

5 Claims, 7 Drawing Sheets

DEVICE FOR UNLOCKING DOORS

FIELD AND BACKGROUND OF THE INVENTION

The present invention relates to a device for unlocking doors of a motor vehicle in the event of a malfunction.

Such a device (lock) for the unlocking of doors of a motor vehicle in the event of a malfunction is known from European Patent Application EP 0 589 158 A1. In addition to the operation of the lock described therein by activated switches which detect the actuating of the door handle and connect a setting drive which moves a locking pawl from a locking position which locks the rotary latch into an open position which releases the rotary latch, measures have been taken for the event of a malfunction. An actuator of the drive can, for instance, be displaced by a crash sensor or, in the event of a malfunction, by a sensor which detects the malfunction, in such a manner that a coupling element or the setting drive enters into an active position in which transmission elements permit an unlocking of the pawl by the actuating of a door handle. However, this has the disadvantage that the setting drive is used both for the normal case and in the event of a malfunction and therefore does not operate reliably in the event of a malfunction. If the crash sensor detects a predetermined deceleration of the vehicle the microswitches are placed in active condition so that the lock can still be actuated after actuation of a door handle. However, if the current supply fails or if the central electronic system of the car is defective, the electric actuation of the lock also fails. Then, however, it is no longer possible, even by corresponding control of the setting drive, for a swing lever to swing into an active position in which the door handle moves the pawl mechanically into its unlocked position via a pull cable and a swing lever. Therefore the lock cannot be opened either electrically or mechanically, which is extremely unsatisfactory from the standpoint of safety.

The connecting of an additional battery requires an evaluation and switch logic, which itself is subject to breakdown and is cost-intensive, as is the additional battery.

A known mechanically operating lock does not have an electrically operable setting drive so that in this case no measures are provided for actuating the lock in the event of a malfunction.

SUMMARY OF THE INVENTION

It is an object of the invention to provide a device for unlocking doors of a motor vehicle which in the event of a malfunction, and particularly in the event of an accident of the motor vehicle, opens, or can be opened, reliably and dependably and does not require the feeding of electric current after the malfunction.

According to the invention, this object is achieved by a setting device which unlocks the door, and which can be operated without the feeding of current in the event of a malfunction.

First of all, it should be pointed out that by the expression "electric unlocking" (opening), it is to be understood that the unlocking process (opening process) is brought about by an electric pulse. The pulse can be produced, for instance, by the closing of a switch or else by the contacting of a sensitive sensor or in some other manner (for instance, via a remote control). This pulse is then converted into setting commands, possibly with the consideration of further parameters such as, for instance, a child-proof door catch, in which case, the setting commands control a setting device which may be a hydraulic, pneumatic, electromagnetic or electromotor setting device. These setting devices act directly or stepped-down (for instance by means of a gear), possibly with the interposition of a clutch in order to avoid overload, on the pawl for the release of the rotary latch or corresponding elements.

The setting device which unlocks the rotary latch and can be operated independently of the supply of current after a malfunction, so that the door can be opened, has the advantage that the door can be effectively opened (for instance by rescue personnel after an accident) even if the entire electric current supply has failed as a result of the accident. In this way, rapid rescue measures can be taken and help given since the door can be opened without the use of tools, since the use of tools is time-consuming and may possibly be dangerous for the passengers within the vehicle.

As a further development of the invention, in the case of a rotary latch (1.1) which cooperates with a closure wedge (1.5) or the like and can be locked by a pawl (1.3) in a locking position, wherein upon the actuation of the pawl (1.3), the rotary latch (1.1) can be brought into at least one open position, the pawl (1.3) can be brought by a setting movement of the setting device directly or indirectly from the locking position into the open position. This has the advantage that the setting device of the invention acts independently of the electrically operated setting device.

As a further development of the invention, the setting device is a pneumatic setting device (4) which has a setting element which can be functionally connected with the pawl (1.3) in the event of a malfunction and directly actuates the pawl (1.3). The use of the pneumatic setting device has the advantage that the device operates independently of the supply of current, in which connection, due to the direct action on the pawl, assurance is had that immediate, direct actuation of the pawl takes place, which is an advantage in the event that other elements which act on the pawl might be blocked by the failure of the current supply.

As a further development of the invention, the setting device is a pneumatic setting device (4) which has a setting element which, in the event of a malfunction, functionally connects a transmission device with the pawl (1.3), by which device the pawl (1.3) can be indirectly actuated manually. This has the advantage that in the case of a lock which is operated purely by electric motor, a mechanical redundancy can be produced, so that the pawl can, for instance, be actuated by a door inside handle or by a door outside handle and the door thus opened.

As a further development of the invention, the pneumatic setting device (4) has a housing (4.1), a membrane (4.3) which is prestressed against an enclosed space (4.2) within the housing (4.1) and connected to the setting element, being arranged within the housing (4.1). There is thus established an embodiment for the pneumatic setting device in connection with which, due to the dimensioning of the housing, the membrane, and/or the volume, a release pressure at which the setting element is moved can be set.

As a further development of the invention, the setting movement of the setting device can be brought about by a pressure which is produced, in particular, by an ignited pyrotechnical gas generator. In this way, the circumstance is utilized that the pressure which is released by the explosion of an airbag or of a belt-tensioning system triggers the setting movement of the setting device so that, upon the explosion, the door is either automatically opened or can be opened indirectly by the door inside handle or the door outside handle.

As a further development of the invention, the setting device has an ignitable pyrotechnic or gas generator which, in the event that a malfunction is noted, triggers the setting movement of the setting device. This has the advantage that, shortly after the time that an excessive acceleration (crash) of the vehicle can be noted, there is still sufficient electric power available so that the setting device itself has an ignitable pyrotechnical gas generator which is then triggered by an electric signal that in this way a setting movement which acts directly or indirectly on the pawl is made possible.

As a further development of the invention, the setting device has at least one device, in particular an electromechanically operating sensor, for detecting the malfunction, which, directly or with time delay, gives off a signal, in particular, for igniting the pyrotechnical gas generator whereby the movement of the setting element is triggered. It is noted that, after an accident, the entire current supply does not immediately collapse but a sufficient supply of current is still available for a short time. As a result, the device or the sensor can be operated before the detection of the malfunction (in particular a deceleration sensor), directly or with time delay, to give off a signal in particular for the igniting of the pyrotechnical gas generator. This triggers a movement of the setting element which, in its turn, acts directly on the pawl or indirectly on the transfer device via which the pawl can be manually actuated.

The device for detecting the malfunction of the sensor can be integrated in a control device which is located, for instance, in the interior of a motor vehicle. The malfunction, for instance, can be due to an accident (crash) of the motor vehicle, in which case the device or the sensor detects a continuous deceleration of the vehicle. As further or alternative criterion for a malfunction, the voltage of the current supply of the vehicle can be used, in which case a malfunction is noted when the voltage drops below a predetermined limit value or fails entirely. This can occur, for instance, due to a self-discharge of the battery, by a loosening of the terminals, or else in the case of a crash. When it is noted that the voltage has dropped below the limit value, the gas generator can be ignited directly or with time delay, in which connection the ignition is ignited by an emergency source of current (for instance, an emergency battery in the form of a lithium battery or a gold condenser). This has the advantage that substantially less energy is required for the igniting of the gas generator than for direct control of an electric motor.

As an example of a condition for the ignition of a gas generator, it may be mentioned here that a current of about 800 mA must be made available for 2 ms, while for the actuating of an electric motor, a current consumption of 4A (per electric motor) for a period of time of about 300 ms is necessary. In this way, the actuation of the pawl by gas generator requires an expenditure of energy which is less by several powers of ten than the direct actuation of the setting device (electric motor).

BRIEF DESCRIPTION OF THE DRAWINGS

With the above and other objects and advantages in view, the present invention will become more clearly understood in connection with the detailed description of preferred embodiments, when considered with the accompanying drawings, of which:

FIGS. 3A–3F are views showing stages in the operation of a lock having a pneumatic setting device in accordance with a first embodiment of the invention wherein FIG. 3F is a detailed view of a part of FIG. 3C;

DETAILED DESCRIPTION OF THE PREFERRED EMBODIMENTS

Figure 1B:
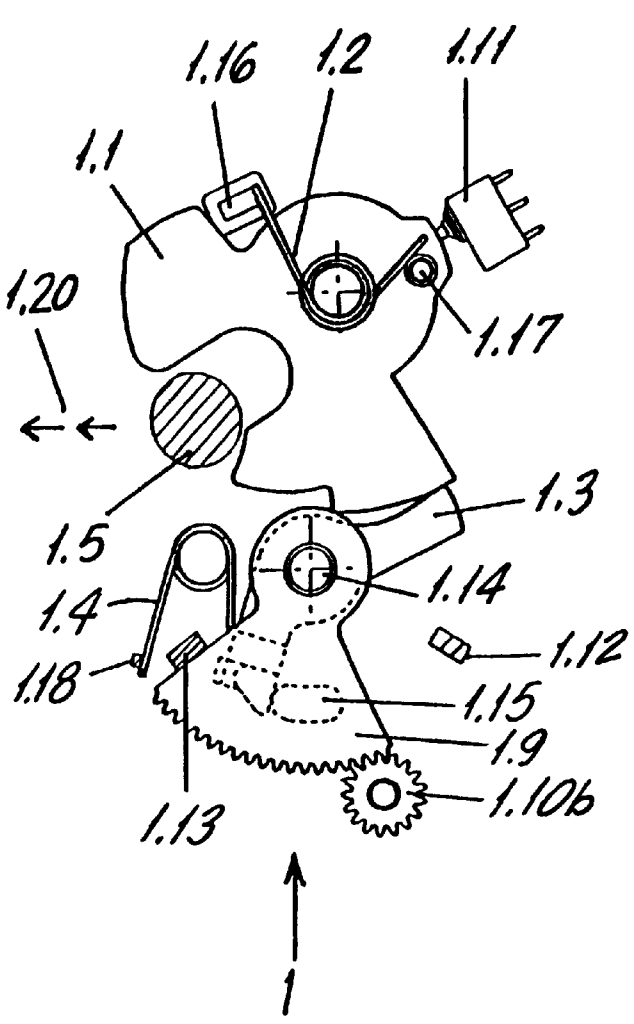
FIG. 1B is a view of the lock in its open position.
Figure 1A:
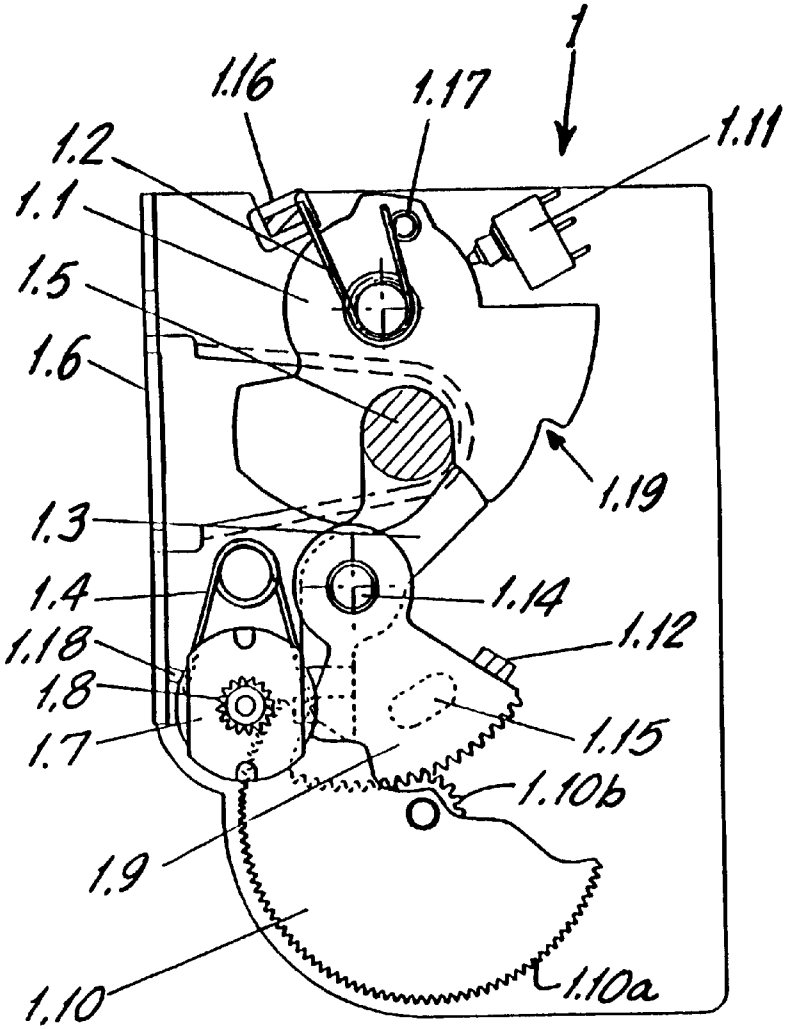
FIG. 1A is a view of a lock in its locked position.

A lock 1 shown in FIGS. 1A–1B has a rotary latch 1.1 which acts against a rotary-latch spring 1.2. The rotary latch 1.1 is held in the locked position shown by a pawl 1.3, which acts against a pawl spring 1.4. The U-shaped rotary latch 1.1 surrounds with its two arms a closure wedge 1.5 and thus in known manner holds a car door, for instance, in its closed position. The above-mentioned components, as well as the components mentioned below, are mounted on a lock plate 1.6, in which connection this lock plate 1.6 may also be a housing which can be easily, simply and in space-saving manner mounted, for instance, within the door of a car.

The setting device is developed as an electric motor 1.7 on the output shaft of which there is a pinion 1.8 which connects with a toothed segment 1.9 which then acts on the pawl 1.3. In FIG. 1A, it is shown that the toothed segment 1.9 is connected via a toothed segment 1.10 to the pinion 1.8. The pinion 1.8 meshes with a large gear wheel 1.10*a* of the toothed segment 1.10 which has, on a common shaft, a smaller gear wheel 1.10*b* which meshes with the toothed segment 1.9. In this way, the bi-directional movement of the electric motor 1.7 is converted and stepped-down in order to actuate the pawl 1.3. For detection of position of the rotary latch 1.1., a rotary latch switch 1.11 is provided which is actuated by a projection on the rotary latch 1.1 when the rotary latch has reached its open position, as shown in FIG. 1B.

Furthermore, the lock 1 has stops 1.12 and 1.13 which limit the end positions of the toothed segment 1.9. In the event that when the toothed segment 1.9 strikes against one of the stops 1.12 or 1.13, and the electric motor 1.7 is also connected to the toothed segment 1.9, a slip clutch (not shown) can be provided at a suitable place between the electric motor 1.7 and the toothed segment 1.9 so that overloading of the electric motor 1.7 and thus damage or destruction are prevented.

In the embodiment shown in FIG. 1A, the pawl 1.3 and the toothed segment 1.9 are turnable independently around a pivot point 1.14, so that a driver 1.15 is associated with the toothed segment 1.9 and, upon actuation of the electric motor 1.7, strikes against an arm of the pawl 1.3 and carries it along, thus releasing the rotary latch 1.1. The rotary latch 1.1, after its release, moves automatically into the open position because the rotary latch spring 1.2 is arranged between two stops 1.16 and 1.17. In the same manner, the pawl 1.3 is spring-loaded by the pawl spring 1.4, the pawl spring resting on one side against the lever of the pawl 1.3 and on the other side against a stop 1.18. Thus, upon actuation of the pawl 1.3, the rotary latch 1.1 is directly released. Furthermore, the rotary latch 1.1 has a shoulder 1.19 into which the pawl 1.3 can, but need not, first of all engage. Upon further movement of the rotary latch 1.1 by the electric motor 1.7, the pawl 1.3 releases the rotary latch 1.1 into its open position shown in FIG. 1B, whereby a two-stroke withdrawal position 1.20 of the car door is made possible.

Figure 2:
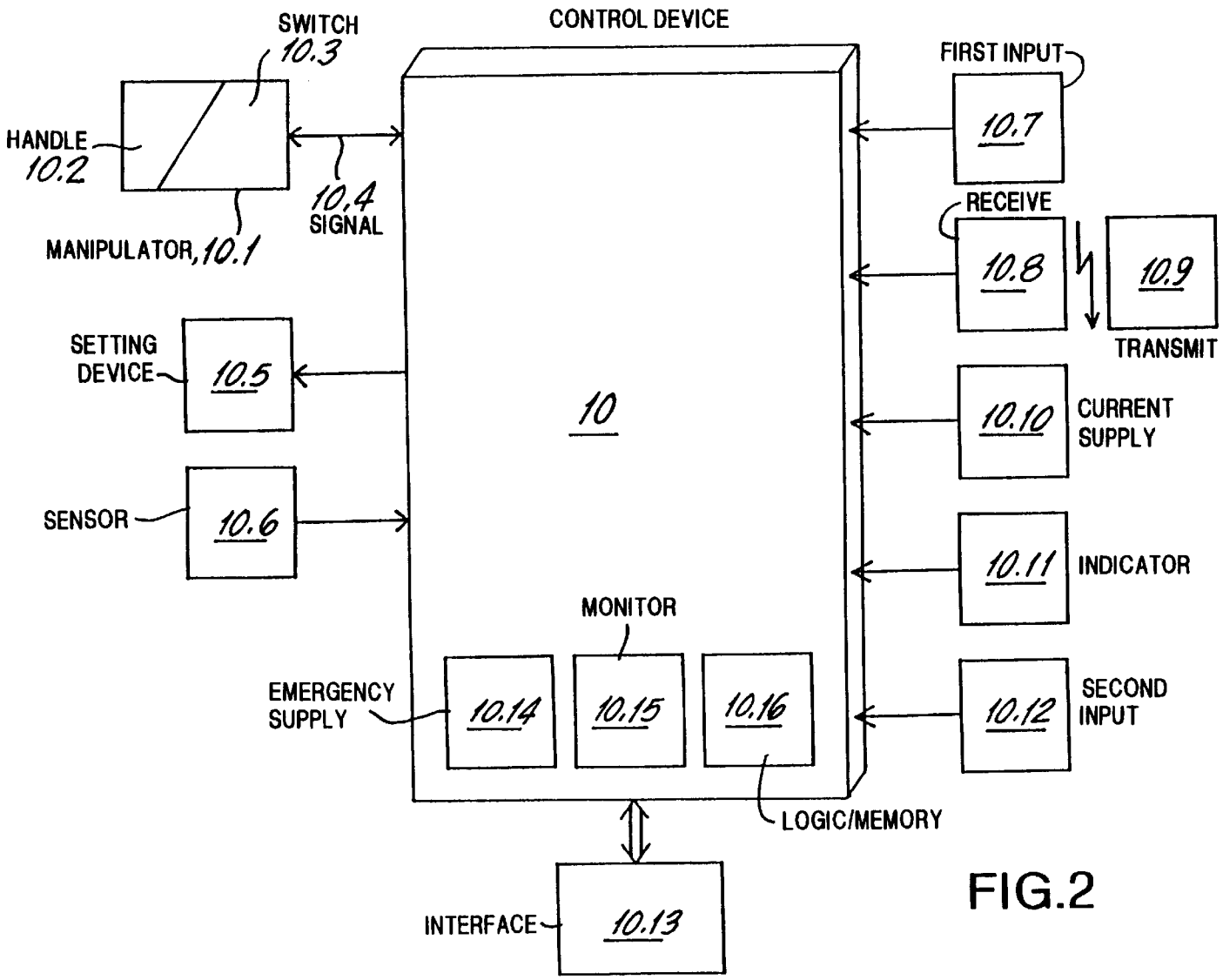
FIG. 2 is a block circuit diagram of a control device.

FIG. 2 shows a control device 10 by which the electric motor 1.7 is controlled as a function of opening and closing commands. The control device 10 has associated with it at least one manipulator 10.1 which has a handle 10.2 and a switch 10.3 (both shown diagrammatically) and are arranged for instance in each case on the inside and outside of a car door. A switch 10.3 is connected via a signal line 10.4 to the control device 10, in which connection, in the case of more than one vehicle door, several manipulators 10.1 may also be present. Furthermore, the control device 10 is connected with a setting device 10.5 (in particular the electric motor 1.7), the control device 10 receiving information as to the position of the rotary latch 1.1 via a sensor 10.6 (rotary-latch sensor 1.11). Furthermore, the control device 10 has associated with it an input device 10.7 (for instance a switch for the activating or deactivating of a child-proof door catch) and a receiving device 10.8, in which connection opening or closing commands can be transmitted to the receiving device 10.8 via a transmitter 10.9.

Furthermore, the control device 10 has associated with it a current supply 10.10, an indicating device 10.11 (to indicate the status) as well as another input device 10.12 (for special functions, as will still be explained). In addition, the control device 10 can be provided with an interface 10.13 via which certain functions can be established over which further information with regard to the status of the vehicle can be transmitted to the control device 10. An emergency current supply 10.14 and a voltage monitoring 10.15 which, for instance, activates the emergency current supply 10.14 when a predetermined voltage threshold is dropped below are integrated in the control device 10. The two components 10.14 and 10.15 can be present, but need not be. By the reference numeral 10.16 there is combined an input control and an output control as well as a control logic and memory logic by which, for instance, stored in a program, the functions of the control device 10 are carried out.

The control device 10 operates as follows:

First of all, let us assume that the switch 10.3 (and possibly also the other switches) are deactivated so that an actuation of the manipulator 10.1 does not result in any movement of the setting device 10.5. That means that the car doors are closed and thus an anti-theft device is connected. If the driver of the vehicle, for instance, desires the opening of at least one door or the actuation of the entire central locking system, he actuates the transmitter 10.9 or, for instance, also the other input device 10.12, it being so developed that it can be actuated only under certain conditions with which the driver is, for instance, acquainted. This can, for instance, be the entering of a numerical code.

After this entering or actuation of the transmitter 10.9, the switch or switches 10.3 are switched into active position so that then, after actuation of the handle 10.2, the setting device 10.5 is actuated, i.e. the electric motor 1.7 is connected until the rotary latch 1.1 is released into its open position by the pawl 1.3 (or until the pawl 1.3 comes against the stop 1.12 as can be noted by another sensor, not shown). When the rotary latch 1.1 has reached its open position, this is recognized by the sensor 10.6 (rotary latch switch 1.11) and the control device 10.5 is disconnected.

After the recognition of the open position, a reversal in direction of rotation of the electromotor 1.7 advantageously takes place so that the toothed segment moves back into the position shown in FIG. 1A and the pawl 1.3 is pressed by the pawl spring 1.4 against the rotary latch 1.1, so that when the door is closed, i.e. the closure wedge 1.5 is forced into the rotary latch 1.1, the spring-loaded pawl 1.3 holds the rotary latch 1.1 after a "snapping" in its locked position. As an alternative, it is possible that a sensor (not shown in FIGS. 1A, 1B) for detecting the position of the closure wedge 1.5 also be provided so that when the latter has reached a position substantially such as shown in FIG. 1*a,* the pawl 1.3 is moved via the toothed segments 1.9 and 1.10 into the locked position. For this purpose, the pawl 1.3 would be rigidly connected with the toothed segment 1.9 in the embodiment shown.

Figures 3A, 3B, 3C, 3F:
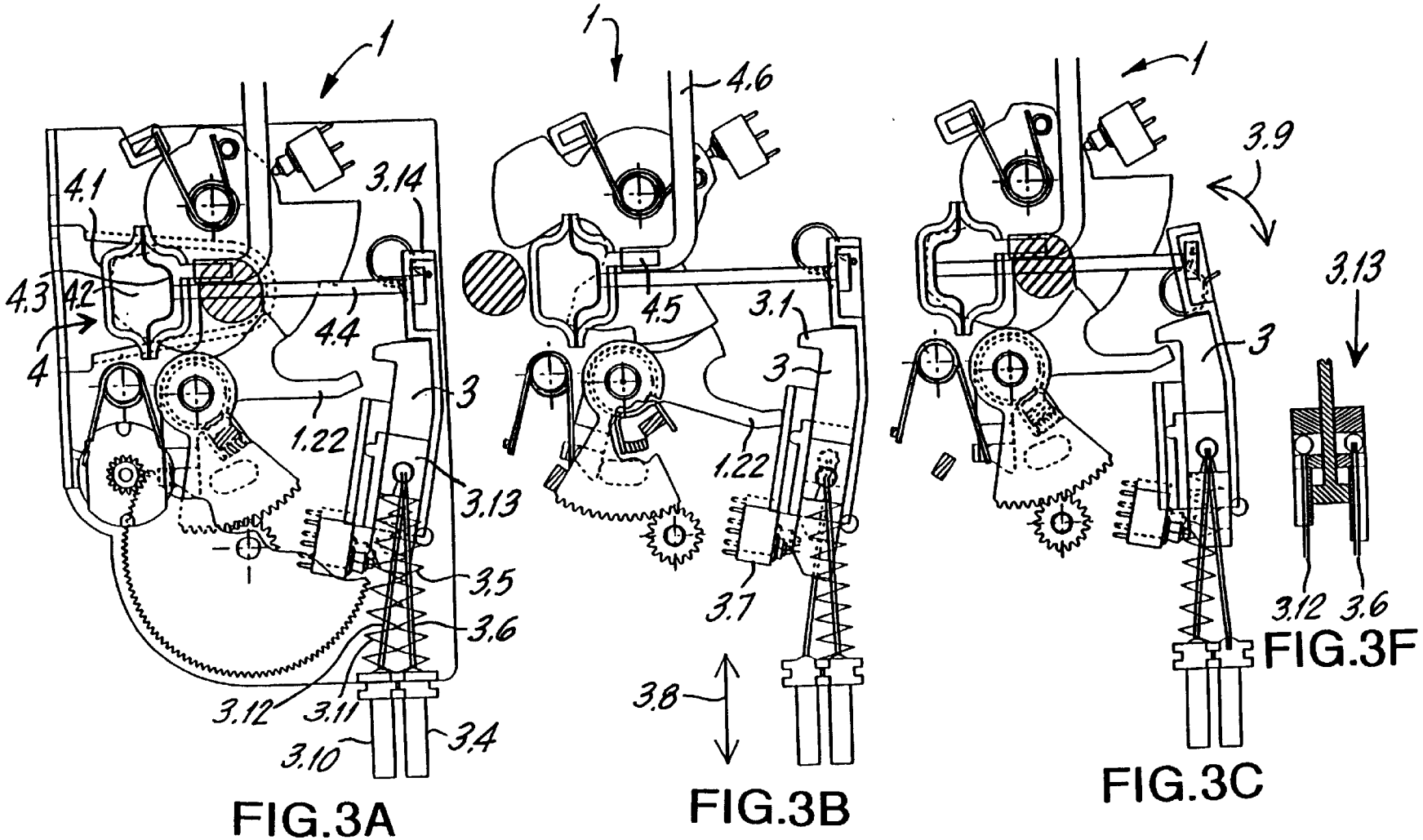

The embodiment shown in FIGS. 3A–3C is based on the structural embodiment shown in FIGS. 1A–1B, with modifications with respect to the step-down gearing being entirely possible. In addition to the components shown in FIGS. 1A–1B, the lock 1 furthermore has the components or modifications described below. The pawl 1.3 is provided with a lever arm 1.22 which can be functionally connected with an inner lever 3. A Bowden cable 3.4 has a core 3.6 which is movable against a spring 3.5 and is connected, for instance, to a door outside handle. The movement of the inner lever 3 can be detected by means of an inner lever switch 3.7 (FIG. 3B). The reference numeral 3.8 indicates the direction of movement of the inner lever 3. In FIG. 3A, a disconnected position (an anti-theft position) is shown in which the inner lever 3 is out of engagement with the lever arm 1.22. Thus, the pawl 1.3 cannot be positioned either by a movement of the inner lever 3 nor by a movement by the electric motor 1.7.

The lock 1 furthermore has a pneumatic setting device 4 which consists of a housing 4.1 with a membrane 4.3 which seals off an enclosed space 4.2 from the surrounding atmosphere. On the membrane 4.3 there is arranged a ram 4.4 which, via a resting part 3.14 of the lever 3, holds the latter at a distance from the lever arm 1.22. Furthermore, the pneumatic setting device 4 has a pressure opening 4.5 which is connected with a pressure connection 4.6 (FIG. 3B) which extends into a region in which the explosion pressure of the airbag or of the belt-tensioner is effectively detected.

FIG. 3B shows the open position of the lock 1 which can be produced in the normal case by the movement of the electric motor 1.7.

FIG. 3C shows the lock 1 in the situation of a malfunction of the lock resulting from the explosive pressure of an airbag or of the belt-tensioner, wherein the space 4.2 has been compressed. Herein the membrane 4.3 has swung over and moved the ram 4.4 in such a manner that the projection of the inner lever functionally connected with the lever arm 1.22. In the case of this malfunction, the pawl 1.22 can be brought from its locked position into the open position by pulling on the door inside handle, and thus displacing the slide block 3.13 (FIG. 3F) by the core 3.6, so that the door can be opened. The same applies in the event that a Bowden cable 3.10 is present, which also has a spring 3.11 and a core 3.12, the core 3.12 being connected with the door outer handle.

Figure 3E:
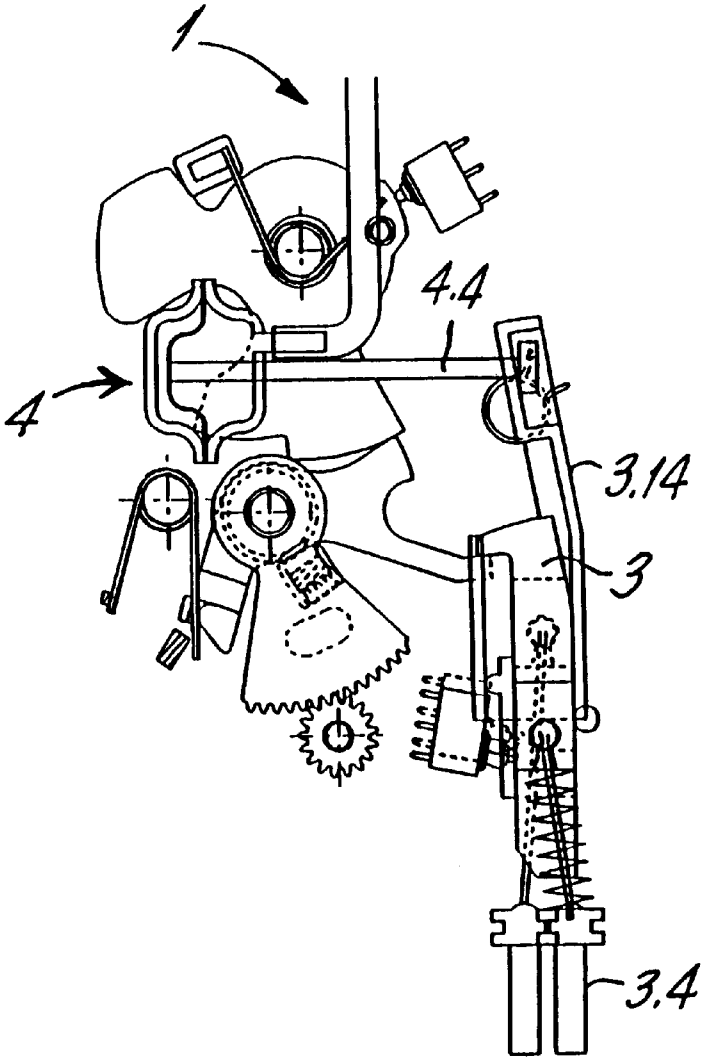
Figure 3D:
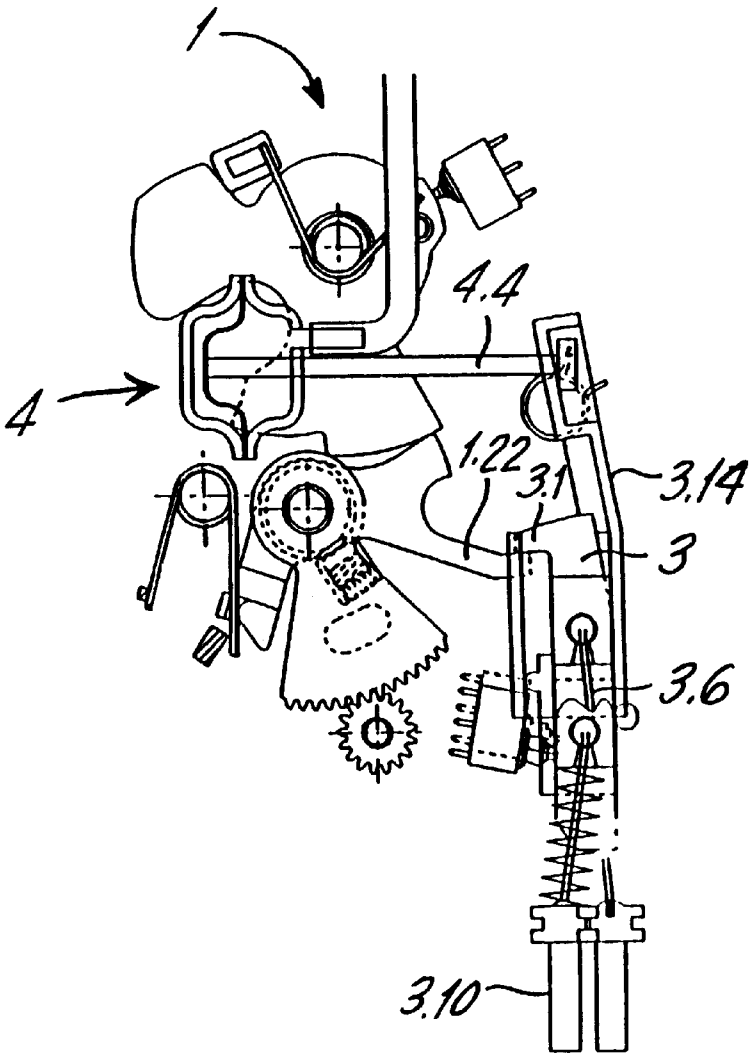

Thus it is shown in FIG. 3D that the door can be opened when the door outer handle is actuated and in FIG. 3E that the door can be opened when the door inner handle is actuated.

FIGS. 4A–4D show another embodiment in which a further swing lever 1.27 having a toothed segment 1.28 which has an arm 1.29 is arranged about a pivot point 1.14. For the limiting of the movement of the arm 1.29, stops 1.30 and 1.31 are provided. The reference numeral 4.7 designates means which convert the detected explosive pressure of the airbag or of the belt tensioner into a rotary movement, or whereby a rotary movement is triggered by the explosive pressure. The means 4.7 can possibly also be an electric motor or a pressure accumulator. This rotary movement is converted by a pinion 1.26, and via the toothed segment 1.28, into a movement providing for a swinging of the toothed segment 1.28 to swing the inner lever 3 in the direction of the lever arm 1.22 of the pawl 1.3. Thereby, the opening of the lock 1 and of the door is made possible via the actuation of the inner lever 3.

Figure 4B:
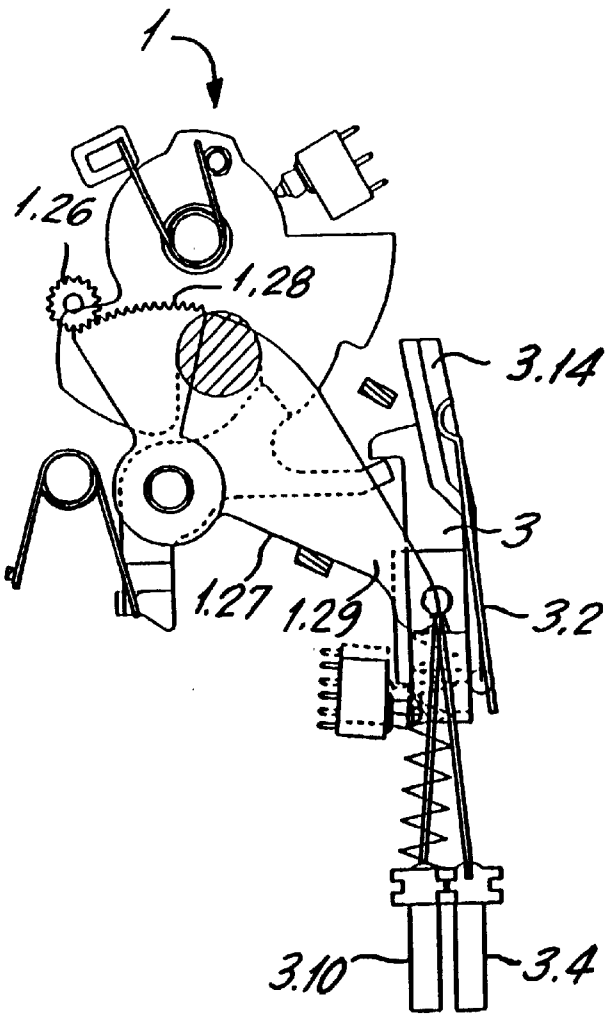
FIGS. 4A–4E are views showing stages in the operation of another embodiment of a device in accordance with the invention.
Figure 4A:
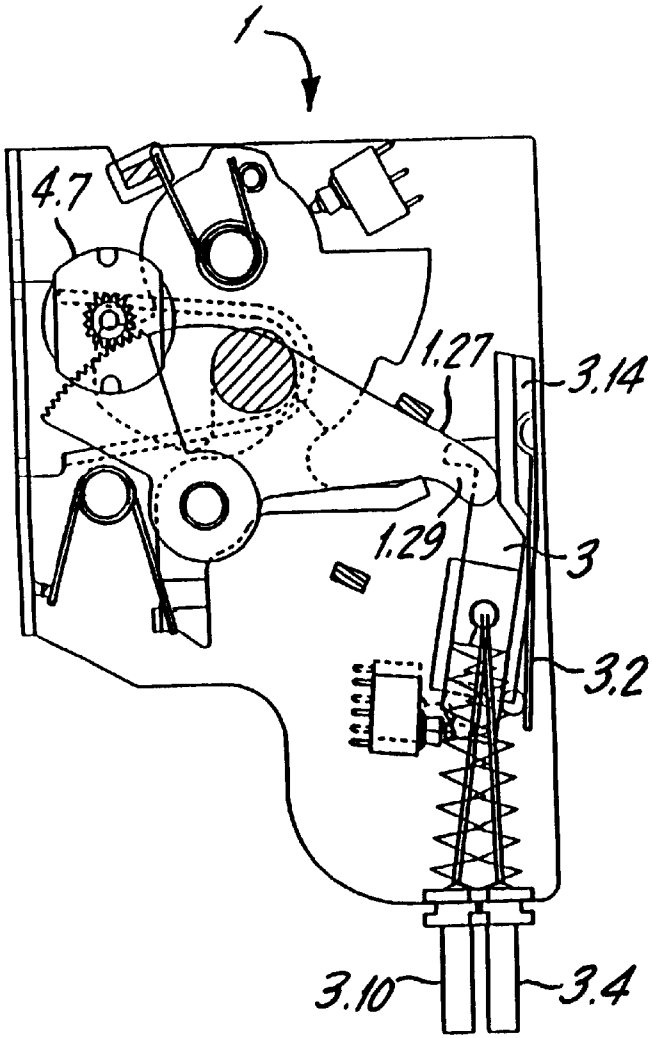
Figure 4E:
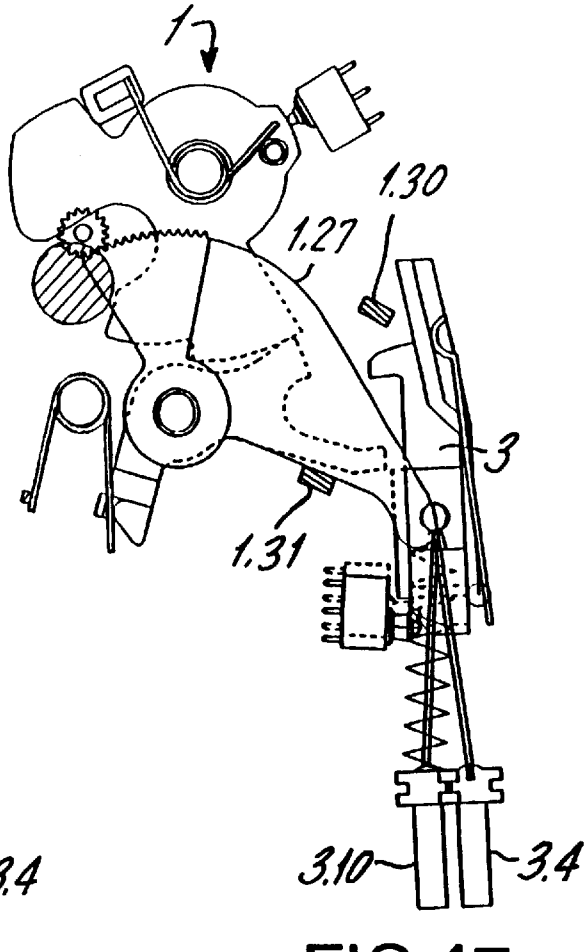
Figure 4D:
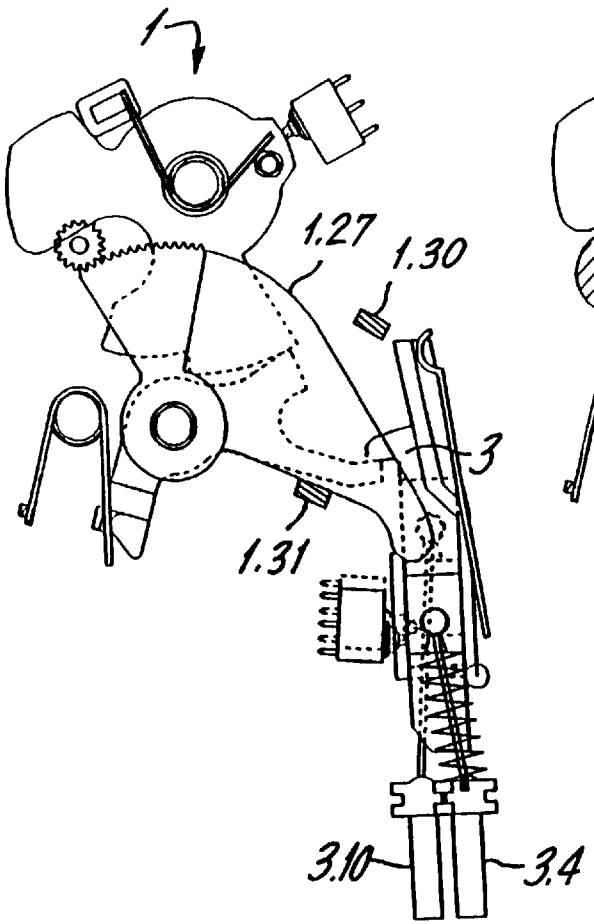
Figure 4C:
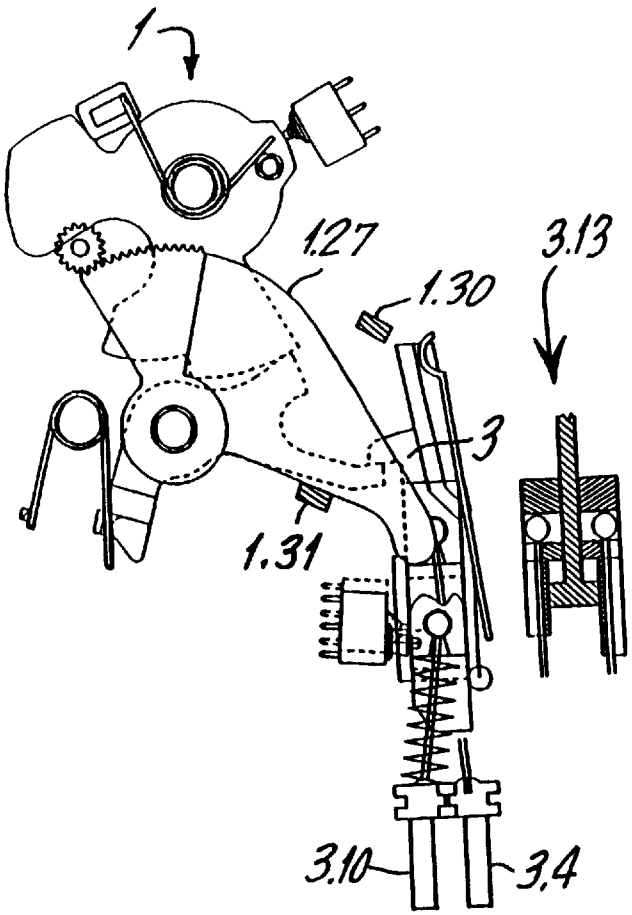

FIG. 4A shows the anti-theft position of the lock 1, in which neither actuation of the electric motor nor of the means 4.7 or of the inner lever 3 (which is uncoupled and therefore inactive) is possible, so that the door cannot be opened. FIG. 4B shows a malfunction in which the inner lever 3 is functionally connected with the lever arm 1.22. By actuating the door outside handle (FIG. 4C) or the door inside handle (FIG. 4D), both of which can take place independently of each other or jointly via the slide block 3.13, the door can be opened. FIG. 4E shows the case that while, due to the released airbag or belt-tensioner the inner lever 3 is swung inward, there is however still sufficient electric energy available, and/or the control device 10 is still operable, so that actuation of the electric motor 1.7 is still possible.

Figure 5:
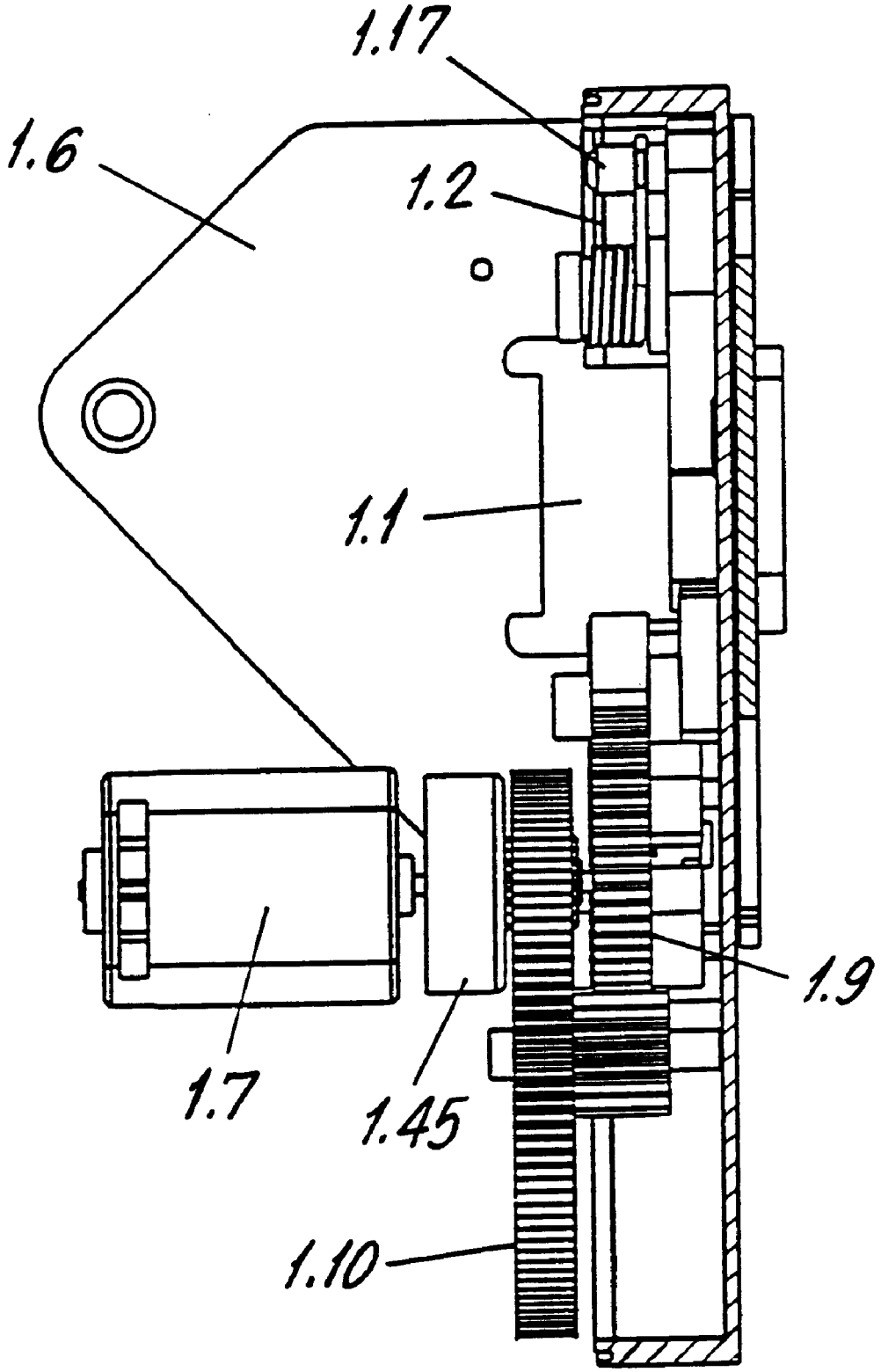
FIG. 5 is a cross section through the lock.

FIG. 5 is a cross section through the lock along the dashed line shown in FIG. 1A.

It may also be pointed out that the lock described can be used in general in doors, car trunks, glove compartments, gas-tank closure caps and the like of vehicles, and particularly passenger cars.

We claim:

1. A vehicular door lock including a device for unlocking the door of a motor vehicle in the event of a malfunction of the door lock, comprising:

a setting device which unlocks the door, the setting device being operable without the feeding of current thereto in the event of the malfunction;

a rotary latch, a closure wedge, and a pawl, the wedge being engagable by the latch during a locking of the door, and the latch being held in a locking position by the pawl during the locking of the door;

wherein upon the actuation of the pawl, the rotary latch is movable into at least one open position, and the pawl is movable by a setting movement of said setting device directly or indirectly from the locking position into an open position;

said setting device is a pneumatic setting device which has a setting element which is functionally connectable with the pawl in the event of a malfunction for direct actuation of the pawl; and wherein said pneumatic setting device comprises a housing, and a membrane which is prestressed against an enclosed space within the housing and is connected to said setting element, the setting element being arranged within the housing.

2. A vehicular door lock including a device for unlocking the door of a motor vehicle in the event of a malfunction of the door lock, comprising:

a setting device which unlocks the door, the setting device being operable without the feeding of current thereto in the event of the malfunction;

a rotary latch, a closure wedge, and a pawl, the wedge being engagable by the latch during a locking of the door, and the latch being held in a locking position by the pawl during the locking of the door;

wherein upon the actuation of the pawl, the rotary latch is movable into at least one open position, and the pawl is movable by a setting movement of said setting device directly or indirectly from the locking position into an open position;

said setting device is a pneumatic setting device which has a setting element which, in the event of a malfunction, functionally connects said transmission device with the pawl to enable indirect manual actuation of the pawl; and wherein said pneumatic setting device comprises a housing, and a membrane which is prestressed against an enclosed space within the housing and is connected to said setting element, the setting element being arranged within the housing.

3. A vehicular door lock including a device for unlocking the door of a motor vehicle in the event of a malfunction of the door lock, comprising:

a setting device which unlocks the door, the setting device being operable without the feeding of current thereto in the event of the malfunction;

a rotary latch, a closure wedge, and a pawl, the wedge being engagable by the latch during a locking of the door, and the latch being held in a locking position by the pawl during the locking of the door;

wherein upon the actuation of the pawl, the rotary latch is movable into at least one open position, and the pawl is movable by a setting movement of said setting device directly or indirectly from the locking position into an open position;

a pyrotechnic or gas generator; and wherein the setting movement of said setting device can be brought about by a pressure which is produced by said pyrotechnic or gas generator upon ignition of the pyrotechnic or gas generator.

4. A vehicular door lock including a device for unlocking the door of a motor vehicle in the event of a malfunction of the door lock, comprising:

a setting device which unlocks the door, the setting device being operable without the feeding of current thereto in the event of the malfunction; and a rotary latch, a closure wedge, and a pawl, the wedge being engagable by the latch during a locking of the door, and the latch being held in a locking position by the pawl during the locking of the door;

wherein upon the actuation of the pawl, the rotary latch is movable into at least one open position, and the pawl is movable by a setting movement of said setting device directly or indirectly from the locking position into an open position;

said setting device comprises means for sensing a malfunction, and trigger means for triggering the setting movement of said setting device upon a sensing of said malfunction, said trigger means being an ignitable pyrotechnic or gas generator.

5. The lock according to claim 4, wherein said setting device comprises at least one electromechanically operating sensor for detecting the malfunction, said sensor giving off, directly or with time delay, a signal for igniting the pyrotechnic or gas generator whereby the movement of the setting element is triggered.

* * * * *